US010787881B2

(12) United States Patent
Jerez

(10) Patent No.: US 10,787,881 B2
(45) **Date of Patent: *Sep. 29, 2020**

(54) DRILL STRING APPARATUS WITH INTEGRATED ANNULAR BARRIER AND PORT COLLAR, METHODS, AND SYSTEMS

(71) Applicant: Halliburton Energy Services, Inc., Houston, TX (US)

(72) Inventor: Hernando Jerez, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/197,535

(22) Filed: Nov. 21, 2018

(65) Prior Publication Data

US 2019/0085656 A1 Mar. 21, 2019

Related U.S. Application Data

(63) Continuation of application No. 15/529,871, filed as application No. PCT/US2014/072998 on Dec. 31, 2014, now Pat. No. 10,145,204.

(51) Int. Cl.

| | |
|---|---|
| ***E21B 33/14*** | (2006.01) |
| ***E21B 7/04*** | (2006.01) |
| ***E21B 43/10*** | (2006.01) |
| ***E21B 33/16*** | (2006.01) |
| ***E21B 7/20*** | (2006.01) |
| ***E21B 7/06*** | (2006.01) |

(Continued)

(52) U.S. Cl.

CPC ..... *E21B 33/16* (2013.01); *E21B 7/06* (2013.01); *E21B 7/20* (2013.01); *E21B 7/208* (2013.01); *E21B 17/05* (2013.01); *E21B 17/105* (2013.01); *E21B 33/127* (2013.01); *E21B 4/02* (2013.01); *E21B 7/28* (2013.01)

(58) Field of Classification Search

CPC . E21B 33/14; E21B 7/20; E21B 43/10; E21B 33/126; E21B 33/143

See application file for complete search history.

(56) References Cited

U.S. PATENT DOCUMENTS 4,158,388 A * 6/1979 Owen ..... E21B 29/02 166/100

4,699,224 A 10/1987 Burton (Continued)

FOREIGN PATENT DOCUMENTS

CN 2589659 12/2003
CN 101748978 6/2010

(Continued)

*Primary Examiner* — Zakiya W Bates

(74) *Attorney, Agent, or Firm* — Chamberlain Hrdlicka

(57) ABSTRACT

A drill string apparatus includes an upper casing section having a port collar. The port collar provides a controllable opening from an interior of the upper casing section to an annulus around the upper casing section. A lower casing section is coupled to the upper casing section through a swivel. The lower casing section includes an external casing packer and a casing pad coupled to an external portion of the lower casing section. The external casing packer is expandable to an annulus around the lower casing section before a cement operation to avoid cement loss circulation to weak formation below the packer.

29 Claims, 4 Drawing Sheets

(51) Int. Cl.

| | |
|---|---|
| ***E21B 17/05*** | (2006.01) |
| ***E21B 33/127*** | (2006.01) |
| ***E21B 17/10*** | (2006.01) |
| *E21B 4/02* | (2006.01) |
| *E21B 7/28* | (2006.01) |

(56) References Cited

U.S. PATENT DOCUMENTS

| | | | | |
|---|---|---|---|---|
| 4,869,323 | A | 9/1989 | Stagg | |
| 5,197,553 | A | 3/1993 | Leturno | |
| 5,271,472 | A | 12/1993 | Leturno | |
| 5,743,333 | A | 4/1998 | Willauer et al. | |
| 6,408,945 | B1 * | 6/2002 | Telfer | E21B 23/006 166/311 |
| 7,784,552 | B2 | 8/2010 | Brouse | |
| 7,857,052 | B2 | 12/2010 | Giroux et al. | |
| 7,861,781 | B2 | 1/2011 | D'Arcy | |
| 8,708,056 | B2 | 4/2014 | Helms et al. | |
| 2005/0126826 | A1 | 6/2005 | Moriarty et al. | |
| 2008/0277163 | A1 | 11/2008 | Moriarty | |
| 2012/0168178 | A1 | 7/2012 | Eriksen et al. | |
| 2015/0330180 | A1 * | 11/2015 | Barannikow | E21B 34/066 166/285 |
| 2017/0306719 | A1 | 10/2017 | Jerez | |

FOREIGN PATENT DOCUMENTS

| | | |
|---|---|---|
| RU | 2262578 | 10/2005 |
| RU | 2437997 | 12/2011 |
| WO | 2015084374 | 6/2015 |

* cited by examiner

DRILL STRING APPARATUS WITH INTEGRATED ANNULAR BARRIER AND PORT COLLAR, METHODS, AND SYSTEMS

BACKGROUND

Wellbore integrity is almost always a consideration when conveying a casing or liner-while-drilling downhole. Wellbore integrity may be affected by reservoir depletion, complex drilling trajectory, tectonics, fault formation, or reactive formations.

In a weak geological formation, the drill bit may be combined with the casing or liner during the drilling operation. Thus, a wellbore with weak walls is lined while the wellbore is drilled. However, this may present issues with cementing the casing or liner in place due to weak formations not being able to withstand the heavier cement column, getting into a loss of cement circulation and jeopardizing the cement and borehole integrity.

DETAILED DESCRIPTION

To address some of the challenges described above, such as the need to maintain wellbore integrity and rotate the casing/liner during drilling, as well as others, apparatus, systems, and methods are described herein that may operate to improve cementing of casings or liners in a wellbore that have been conveyed into the wellbore coupled to a drill bit. Examples of such embodiments are now described in detail.

Figure 1:
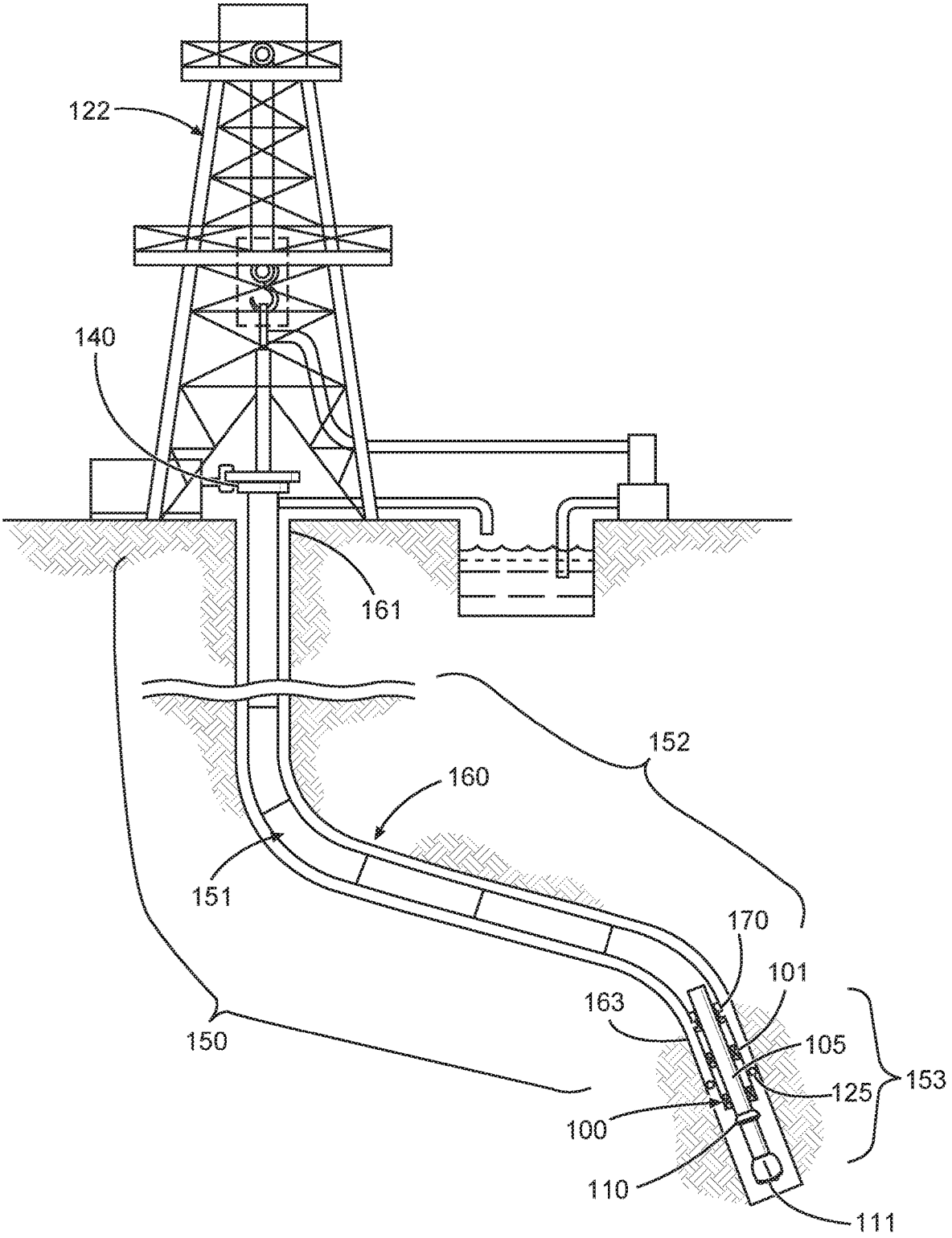
FIG. 1 is a diagram of a drilling system including a drill string apparatus in a borehole, according to various aspects of the present disclosure.

FIG. 1 is a diagram of a drilling system including a drill string apparatus 100 in a borehole, according to various aspects of the present disclosure. The drill string apparatus is shown in greater detail in FIG. 2 and discussed subsequently.

Methods, systems, and apparatuses are disclosed for effecting directional (i.e., steerable) drilling. The directional drilling may include casing-while-drilling operations and/or liner-while-drilling operations.

In casing-while-drilling operations, a casing string is used as the drill string (i.e., instead of drilling pipe, the casing string itself is rotated and imparts rotation to a drill bit disposed at a downhole or lower end of the casing string, such that as drilling proceeds, the casing string is lowered into the borehole). A "liner" is a particular kind of casing string which does not extend to the top of the borehole. Thus, in liner-while-drilling operations, the drill string may comprise drill pipe coupled to the liner, which in turn is coupled to a rotary steerable system (RSS) (which likewise may be part of or otherwise included in a bottom hole assembly (BHA)).

In the interest of brevity, subsequent discussions refer only to casings and casing-while-drilling. Due to the similarity of casings and liners, it will be assumed that all references to casings and casing-while-drilling are also references to liners and liner-while-drilling.

Directional drilling may be accomplished by the RSS that may include a mechanism to deviate a drill bit radially from the axis of a drill string in a "point-the-bit" manner. The RSS is disposed in an RSS housing that is coupled to the casing or liner string such that the RSS is disposed within the casing or liner string. The RSS, in some embodiments, may be part of, or otherwise included in, a BHA. The RSS may be coupled to an underreamer and/or a drill bit disposed at the downhole or lower end of the casing string. As described subsequently with reference to FIG. 2, the RSS is rotationally fixed with respect to a lower section 153 of a casing string 150. At the same time, the lower section 153 anchors and grabs the borehole, thus keeping the RSS and electronics stationary for tracking toolface.

Referring to FIG. 1, the drill string apparatus 100 is disposed at a lower or downhole end of the casing string 150 being used as the drill string. The drill string apparatus 100 may include an underreamer 110 and drill bit 111 disposed at the lower or downhole end of the casing string.

FIG. 1 shows the drill bit 111 and underreamer 110 as separate elements with the underreamer 110 mounted to an internal shaft of the RSS behind the drill bit. However, a drill bit 111 may itself comprise a reamer and/or a drill bit 111 may comprise any suitable device for boring or enlarging a hole to be substantially larger than the outer diameter of a casing string 150 (e.g., a bi-center bit).

The drill string apparatus 100 further includes an RSS 105 disposed within the casing string 150. Some part or parts of the RSS 105 may be operatively coupled to the casing string 150 such that rotational forces from the casing string 150 are imparted only to the operationally coupled parts of the RSS 105, and in turn to the underreamer 110 and/or drill bit 111. In such embodiments, some portions of the RSS 105 (e.g., its housing and components disposed thereon) may be operated as substantially non-rotating portions.

Figure 2:
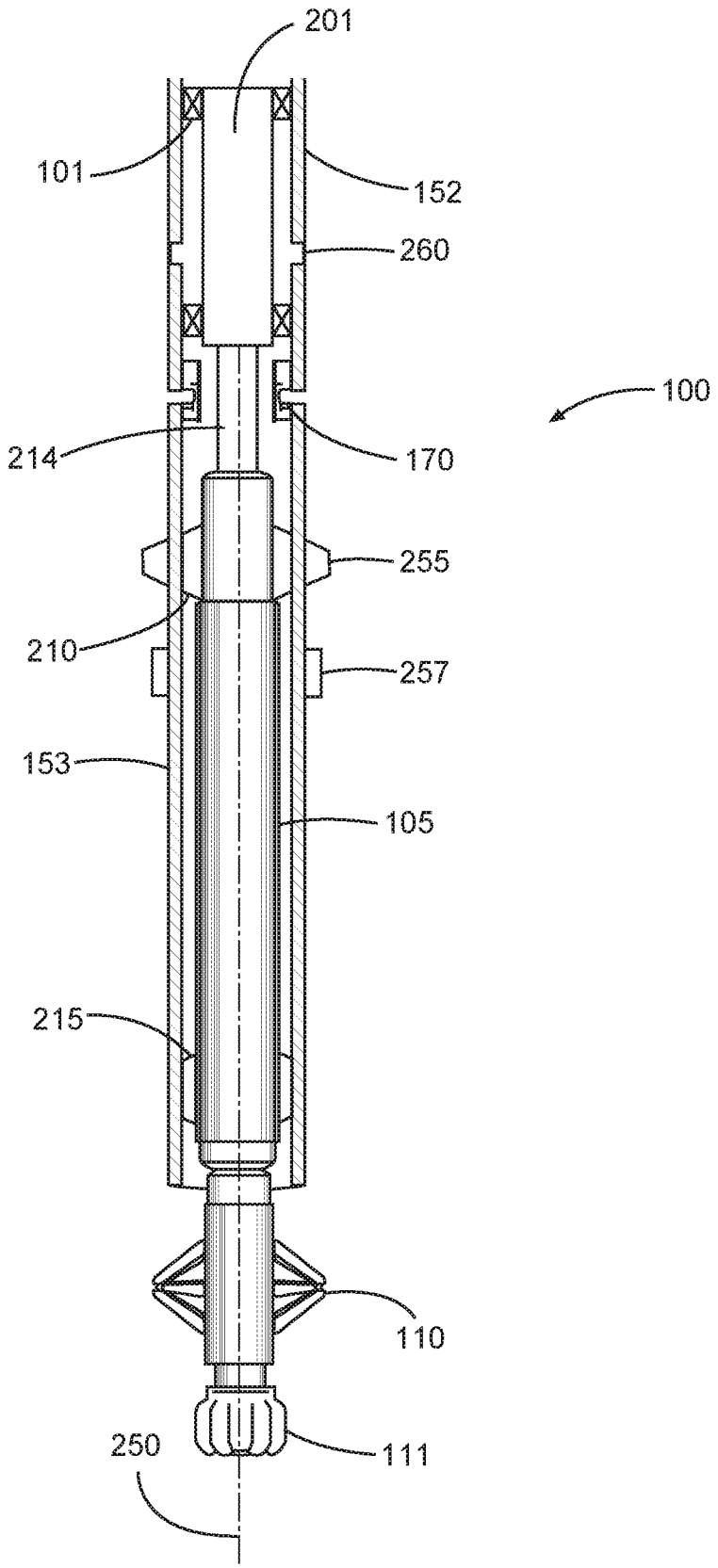
FIG. 2 is a diagram showing a more detailed view of the drill string apparatus, according to various aspects of the present disclosure.

In some embodiments, the BHA 100 may include a mud motor (not references in FIG. 1 references in FIG. 2 (201)), which may be actuated or otherwise activated so as to impart rotational forces upon the drill bit, as will be apparent to one having skill in the art with the benefit of this disclosure. In such embodiments, the rotation from the mud motor may be either in addition to or instead of the rotation imparted to the drill bit by rotating the casing string 150. The mud motor includes a rotor and a stator that together use the Moineau principle to rotate the drillstring as a result of the pumping of a fluid (e.g., drilling mud) through the mud motor.

The casing string 150 may further comprise multiple casing joints 151. Each casing joint 151 may be a segment of casing pipe serially coupled to one or more other casing joints 151. Casing joints 151 may, in some instances, be of approximately equal length, and include mechanisms for coupling to other casing joints on either end (e.g., threading for threaded connection either directly to another casing joint or for connection to a casing joint connector capable of receiving threaded ends of two casing joints).

The casing string 150 may extend from the top of the borehole 160 (e.g., point 161) to a downhole point 163 of the borehole 160. Some wells drilled according to certain embodiments of the present disclosure may involve the use of multiple casing strings, in which case each casing string would extend from the top of the borehole 160 to a point downhole, which downhole point may be different for each casing string.

The drill string apparatus 100 includes a swivel, illustrated by the stylized representation of a swivel 170 shown in FIG. 1. The swivel 170 may include any suitable mechanism for coupling two casing joints 151 in a manner that rotational forces from casing joints 151 above the swivel 170 are not transferred to a casing joint or joints 151 below the swivel (e.g., the casing joints 151 below the swivel 170 could be thought of as hanging freely from the portion of the casing string 150 above the swivel 170). Thus, in embodiments wherein the casing string 150 includes a swivel 170, the casing string 150 may be defined to include an upper section (e.g., upper casing section 152) and a lower section (e.g., lower casing section 153), wherein the upper section includes the casing joint or joints above the swivel 170 and the lower section includes the casing joint or joints below the swivel 170. In such embodiments, the RSS 105 may be disposed at least in part within, and/or coupled to, the lower section 153 of the casing string 150.

In some embodiments including a swivel, the casing string 150 may additionally include one or more centralizers 125 disposed along a portion of the casing string 150 within which the RSS 105 is disposed. These centralizers may help the casing string 150 maintain an approximately centered position in the borehole 160.

As noted, the swivel 170 may include one or more mechanisms that enable coupling of two casing joints 151 in a manner that rotational forces from casing joints 151 above the swivel 170 are not transferred to a casing joint or joints 151 below the swivel. For instance, the swivel 170 may include one or more radial force bearing components, one or more axial force bearing components, and a sealing mechanism.

FIG. 2 is a diagram showing a more detailed view of the drill string apparatus 100, according to various aspects of the present disclosure. As discussed previously with reference to FIG. 1, the drill string apparatus 100 includes the underreamer 110 and drill bit 111 disposed at the lower or downhole end of the casing string that includes the upper section 152 above the swivel 170 and the lower section 153 below the swivel 170. The drill string apparatus 100 further includes the RSS 105 disposed within the casing string 150. The RSS housing 105 may be coupled to the casing string 150 by, for example, one or more sets of latches 101.

The drilling string apparatus, in an embodiment, may further include a mud motor 201 operatively coupled to a driveshaft 214 and to the upper section of the upper casing section 152 (e.g., by latches 101). The mud motor 201 may be located above the swivel 170, as shown in FIG. 2. In other embodiments, the mud motor 201 may be located below the swivel 170 connected to a tubular component across the swivel and couple to the upper casing by latches 101. The mud motor 201 may be capable of actuation (e.g., by passing drilling mud through the motor, by sending an electrical signal, or by any other mechanism) so as to impart rotation to the driveshaft 214 and, in turn, the underreamer 110 and bit 111. The mud motor 201 provides rotational forces to the driveshaft 214 and, in turn, the internal shaft of the RSS provides rotational forces to the underreamer 110 and/or drill bit 111).

FIG. 2 further shows the substantially non-rotating (with respect to the lower casing section 153 and upper casing section 152) RSS 105 coupled to the casing (here, lower section of casing 153) using a first set of RSS latches 210 and a second set of RSS latches 215. Thus, the sets of RSS latches 210, 215 rotationally fix the RSS 105 to the lower section of casing 153.

The driveshaft 214 is coupled to the internal shaft of the RSS 105. The internal shaft of the RSS 105 is operatively coupled to the underreamer 110 and/or drill bit 111 so as to enable radial diversion of the underreamer 110 and/or drill bit 111 with respect to the longitudinal axis 250 of the casing string.

The drill string apparatus 100 further includes an integrated annular barrier (e.g., external casing packer) 257 and casing pads 255, external to and disposed on the lower casing section 153. In an embodiment, the external casing packer 257 is disposed below the casing pads 255 on the lower casing section 153 The casing packer 257 may be used later during cementing process to withstand the hydrostatic cement column.

The packer 257 may be inflated with a fluid (e.g., drilling mud) that is injected into the packer 257 prior to cementing in the casing cement method, as discussed subsequently.

The casing pads 255 provide friction with the side of the wellbore in order to hold the lower casing section 153 substantially rotationally stationary in the wellbore. Other mechanisms besides casing pads 255 may be used for this purpose.

A port collar 260 is incorporated in the drill string apparatus 100 above the swivel 170. The port collar 260 is disposed in the upper casing section 152 and may comprise a controllable opening from an interior of the upper casing section 152 to the annulus around the upper casing section 152. The port 260 may be opened for a cementing method as discussed subsequently with reference to the flowchart of FIG. 6. The drill string apparatus 100 also supports a more conventional cementing method, if the geological formation is able to support the hydrostatic pressure of the cement, by keeping the port 260 closed. Thus, during the cementing method of FIG. 6, the port 260 is open allowing cement to flow through the ports and in to the upper section of casing 152 and, during a conventional cementing method, the ports are closed so that the cement flows out the end of the lower section of casing 153. These concepts are shown subsequently and discussed in greater detail with reference to FIGS. 3-5 in combination with the method illustrated in FIG. 6.

Figure 5:
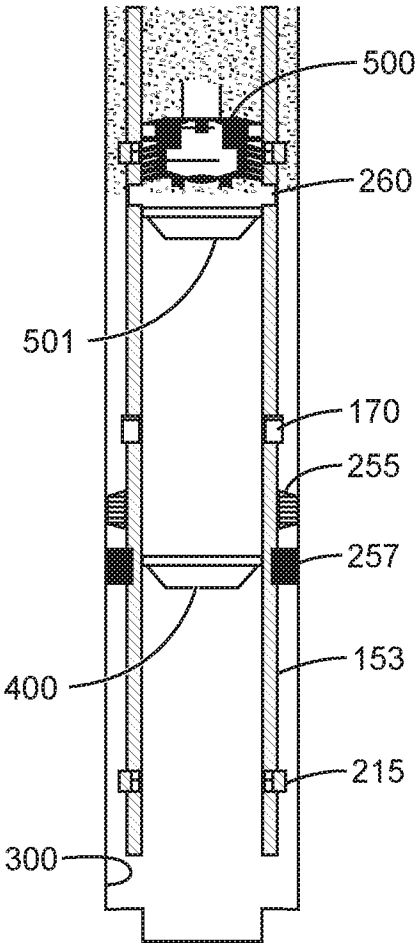
FIG. 5 is a diagram of the lower section of the casing showing the process of opening the port and circulating the cement above the casing packer, according to various aspects of the present disclosure.
Figure 4:
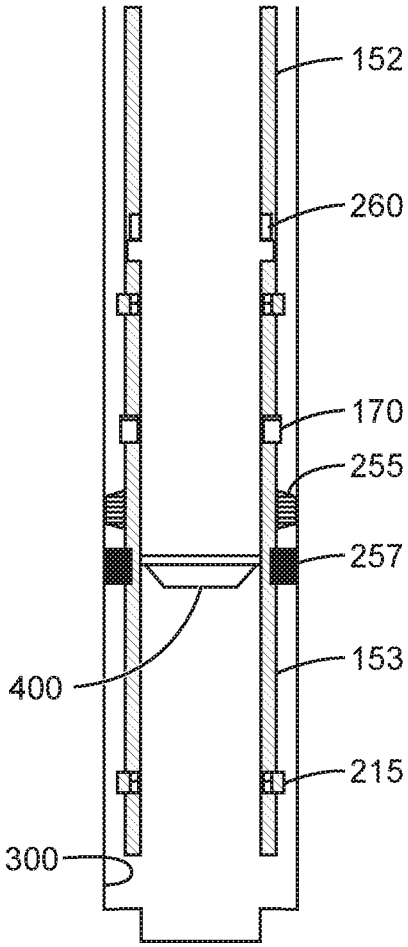
FIG. 4 is a diagram of the lower section of the casing showing a latch plug 400 used to pressurize the casing and then open and inflate the packer, according to various aspects of the present disclosure.
Figure 3:
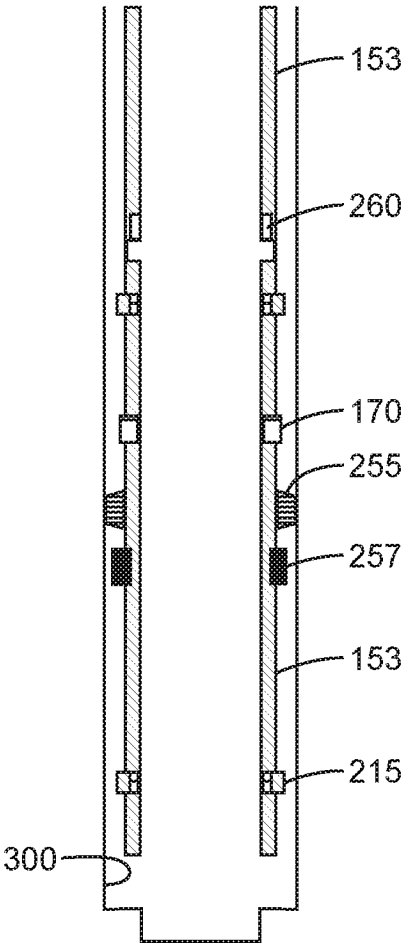
FIG. 3 is a diagram showing the casing after the drilling apparatus has been removed and the casing is in place for cementing, according to various aspects of the present disclosure.
Figure 6:
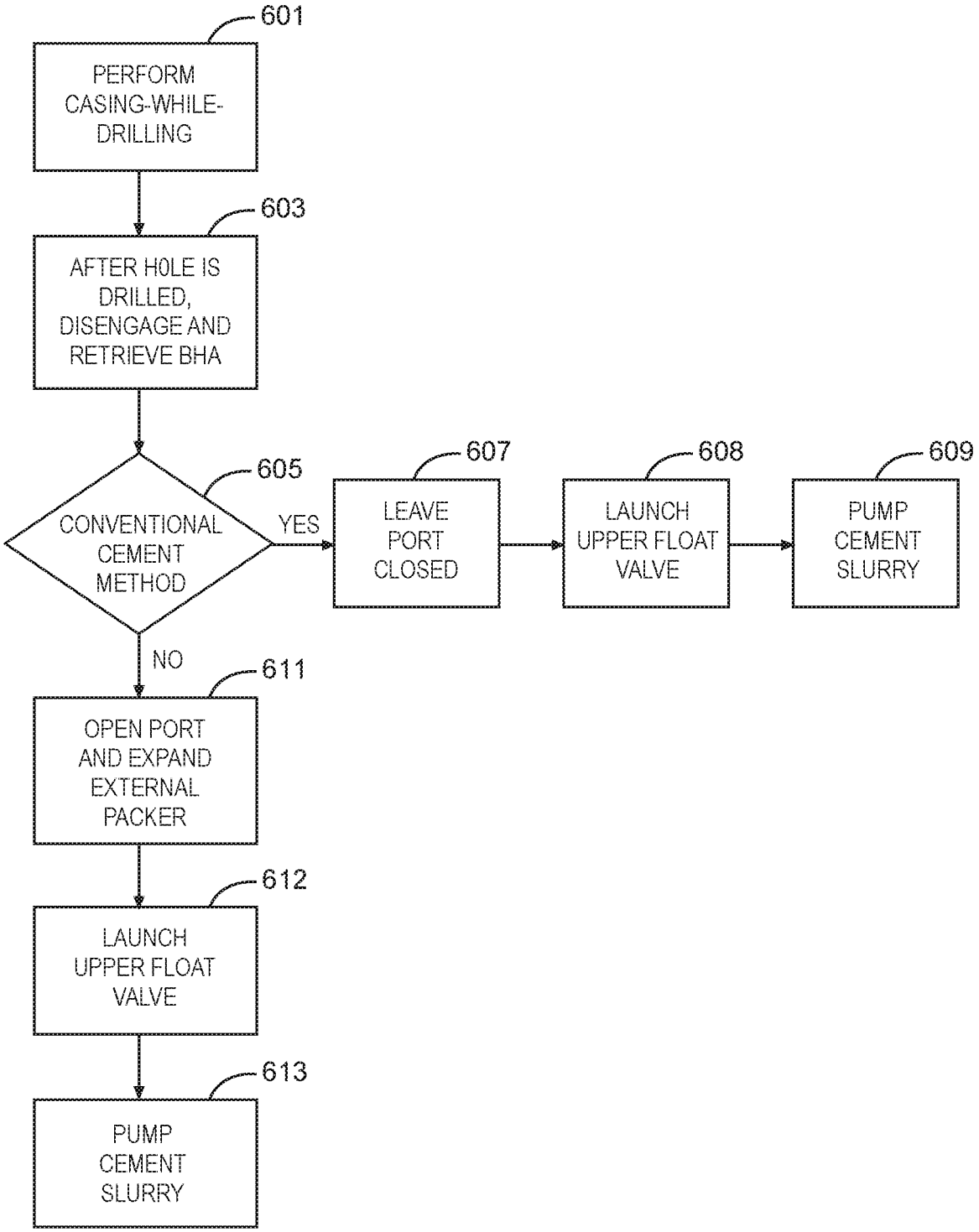
FIG. 6 is a flowchart showing a method for drilling and cementing, according to various aspects of the present disclosure.

FIG. 3 is a diagram showing the casing after the drilling apparatus has been removed and the casing is in place for cementing, according to various aspects of the present disclosure. FIG. 4 is a diagram of the lower section of the casing showing a latch plug 400 used to pressurize the casing and then open and inflate the packer, according to various aspects of the present disclosure. FIG. 5 is a diagram of the lower section of the casing showing the process of opening the port and circulating the cement above the casing packer, according to various aspects of the present disclosure. FIG. 6 is a flowchart showing a method for drilling and cementing, according to various aspects of the present disclosure. The cement injection method will now be described with reference to the drill string apparatus 100 of FIGS. 1-5.

In block 601, a casing-while-drilling operation (e.g., steerable casing-while-drilling) is performed. For example, this operation may be performed as illustrated in FIG. 1. In block 603, once the hole is drilled, the BHA is disengaged and retrieved by fishing with wireline or drill pipe. In directional drilling liner applications, the BHA may be retrieved by temporarily hanging the liner in the parent casing and disengaging the inner string to pull the BHA out of the hole. FIG. 3 illustrates the BHA removed, the upper and lower sections of casing 152, 153 in the borehole 300, and the external packer 257 in a contracted state (i.e., not expanded).

In block 605, it is determined whether the cement process for casing is to be completed in a conventional way (e.g., port 260 closed) or the presently disclosed method with the port 260 open. This decision depends on the wellbore 300 integrity. If the geological formation is determined to be strong enough to withstand a cement column, a conventional cement process can be performed (e.g., port 260 closed). If the geological formation is weaker and may be fractured by the cement column, the present cement method, with the port 260 open, is performed.

When the conventional cement method is used, the ports are left closed 607, in block 607. In block 608, an upper float valve is launched downhole. In block 609, the cement slurry is pumped downhole with a displacement plug that may be landed at the upper float valve in the casing. The result of the conventional cement method is not illustrated in FIGS. 3-5.

In block 611, if the presently disclosed cement method is performed, the external packer 257 is expanded against the wellbore wall 300 and the port 260 is opened. The results of this operation are illustrated in FIG. 4 and FIG. 5. It can be seen that the external packer 257 is now substantially blocking (e.g., sealing) the annulus around the lower section of casing 153.

The casing pads 255 substantially reduce or eliminate the rotation of the lower section of casing 153 with the RSS such that the lower section of casing 153 is substantially, rotationally stationary with respect to the upper section of casing 152.

In block 612, after opening the port, a cement retainer can be run into the hole to be cemented with an inner string or by pumping a float valve plug to be landed on one of the latches 101 in the upper section of the casing. The float valve will prevent cement from performing a U tube effect inside the casing. A plug 400 is used to open the port of the external casing plug.

In block 613, cementing begins by the cement slurry being pumped downhole through the casing with a cement displacement plug that is landed at the upper float valve. The flow of cement is shown in FIG. 5 traveling down the upper casing section 152 and out the port 260. The displacement plug and float valve 500 are illustrated in FIG. 5. During cementing, the upper casing section 152 can be rotated to improve the cement coverage and adherence. The displacement plug and float valve 500 may avoid the occurrence of U-Tubing. U-Tubing is explained subsequently. FIG. 5 now shows the completed cement method with a column of cement 500 in place in the upper casing section 152. Subsequent drilling may use a drill bit to remove the cement within the casing.

The occurrence of U-Tubing may be explained by assuming that a column Y of the tube represents the annulus and a column X represents the pipe (drill string) in the well. The bottom of the U-tube represents the bottom of the well. In most cases, fluids create hydrostatic pressures in both the pipe and annulus. Atmospheric pressure can be ignored, since it works the same on both columns. If the fluid in both the pipe and annulus are of the same density, hydrostatic pressures will be equal and the fluid will remain in static equilibrium on both sides of the tube. If the fluid in the annulus is heavier, it will exert pressure downward and will flow into the drill string, displacing some of the lighter fluid out of the string and causing a flow at surface. The fluid level will fall in the annulus until pressures equalize. This is because a difference in hydrostatic pressures urges the fluid to move until a balance point is reached. This phenomenon is typically referred to as U-tubing and it explains why there may be flow from the pipe when making connections.

The method of FIG. 6 may be used for placing a steerable liner. In such an embodiment, the RSS is latched or coupled to the lower part of the liner.

Example 1 is a directional drill string apparatus, comprising:

an upper casing section comprising a port collar that provides an opening from the upper casing section to an annulus around the upper casing section; and a lower casing section coupled to the upper casing section through a swivel, the lower casing section comprising: an annular barrier coupled to an external portion of the lower casing section; and a casing pad coupled to an external portion of the lower casing section; wherein the external casing packer is expandable to an annulus around the lower casing section prior to cementing.

In Example 2, the subject matter of Example 1 can further include a rotary steerable system (RSS) and RSS housing disposed within the lower casing section.

In Example 3, the subject matter of Examples 1-2 can further include wherein the RSS housing is coupled to the lower casing with at least one set of latches such that the RSS housing is substantially rotationally stationary with respect to the upper casing section.

In Example 4, the subject matter of Examples 1-3 can further include wherein the lower casing section is configured to be stationary while the upper casing section is configured to rotate with the port collar open during the cementing.

In Example 5, the subject matter of Examples 1-4 can further include a drill bit coupled to an internal shaft of the RSS.

In Example 6, the subject matter of Examples 1-5 can further include a mud motor coupled to a driveshaft wherein the driveshaft is coupled to the internal shaft of the RSS.

In Example 7, the subject matter of Examples 1-6 can further include an underreamer coupled to the internal shaft of the RSS between the drill bit and the RSS.

In Example 8, the subject matter of Examples 1-7 can further include wherein the drill bit further comprises an underreamer.

In Example 9, the subject matter of Examples 1-8 can further include wherein the annular barrier comprises an external casing packer that is configured to expand with fluid.

In Example 10, the subject matter of Examples 1-9 can further include wherein the upper casing section comprises an upper liner section and the lower casing section is a lower liner section.

Example 11 is a method for drilling and cementing comprising: performing a drilling operation, with a bottom hole assembly, to create a wellbore; opening ports in an upper section of a casing; expanding an external packer in a lower section of a casing, coupled to the upper section of the casing, against the wellbore wall; and pumping a cement slurry and a cement displacement plug downhole through the casing wherein the open ports are configured to allow the cement slurry to exit the upper section of the casing to an annulus and the external packer is configured to stop the cement slurry from continuing downhole past the external packer.

In Example 12, the subject matter of Example 11 can further include wherein the drilling operation comprises a directional casing-while-drilling operation.

In Example 13, the subject matter of Examples 11-12 can further include wherein the drilling operation comprises a directional liner-while-drilling operation.

In Example 14, the subject matter of Examples 11-13 can further include rotating the upper section of the casing while pumping the cement slurry.

In Example 15, the subject matter of Examples 11-14 can further include maintaining a lower section of casing, coupled to the upper section of casing through a swivel, in a substantially rotationally stationary manner with respect to the upper section of casing.

In Example 16, the subject matter of Examples 11-15 can further include wherein the drilling operation comprises a steerable drilling operation.

In Example 17, the subject matter of Examples 11-16 can further include removing the bottom hole assembly prior to pumping the cement slurry.

Example 18 is a drilling system comprising: a drill string apparatus comprising: an upper casing section comprising a port collar that provides a controllable opening from an interior of the upper casing section to an annulus surrounding the upper casing section; and a lower casing section coupled to the upper casing section through a swivel, the lower casing section comprising: an external casing packer, coupled to an external portion of the lower casing section, the external casing packer configured to expand against a wellbore wall before cement operation; wherein the upper casing section is configured to rotate during the cement operation while the lower casing section is substantially rotationally stationary with respect to the upper casing section.

In Example 19, the subject matter of Example 18 can further include a casing pad coupled to the lower casing section above the external casing packer and configured to hold the lower casing section rotationally stationary in a borehole.

In Example 20, the subject matter of Examples 18-19 can further include a point the bit rotary steerable system (RSS) disposed within the lower casing section, the RSS housing coupled to the lower casing section with at least one set of latches.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A directional drill string apparatus, comprising:

an upper casing section comprising a port collar that provides an opening from the upper casing section to an annulus around the upper casing section; and a lower casing section coupled to the upper casing section through a swivel, the lower casing section comprising:

an annular barrier coupled to an external portion of the lower casing section, wherein the annular barrier is expandable to an annulus around the lower casing section prior to cementing; and a casing pad coupled to an external portion of the lower casing section.

2. The drill string apparatus of claim 1, further comprising a rotary steerable system (RSS) and RSS housing disposed within the lower casing section.

3. The drill string apparatus of claim 2, wherein the RSS housing is coupled to the lower casing with at least one set of latches such that rotational movement between the RSS and the lower casing section is impeded.

4. The drill string apparatus of claim 3, wherein the lower casing section is configured to be stationary while the upper casing section is configured to rotate with the port collar open during the cementing.

5. The drill string apparatus of claim 4, further comprising a drill bit coupled to an internal shaft of the RSS.

6. The drill string apparatus of claim 5, further comprising a mud motor coupled to a driveshaft wherein the driveshaft is coupled to the internal shaft of the RSS.

7. The drill string apparatus of claim 5, further comprising an underreamer coupled to the internal shaft of the RSS between the drill bit and the RSS.

8. The drill string apparatus of claim 5, wherein the drill bit further comprises an underreamer.

9. The drill string apparatus of claim 1, wherein the annular barrier comprises an external casing packer that is configured to expand with fluid.

10. The drill string apparatus of claim 1, wherein the upper casing section comprises an upper liner section and the lower casing section is a lower liner section.

11. The drill string apparatus of claim 1, wherein rotation of the lower casing section is impeded via the casing pad while the upper casing section is rotatable.

12. A drilling system comprising:

a drill string apparatus comprising:

an upper casing section comprising a port collar that provides a controllable opening from an interior of the upper casing section to an annulus surrounding the upper casing section; and a lower casing section coupled to the upper casing section through a swivel, the lower casing section comprising:

an external casing packer, coupled to an external portion of the lower casing section, the external casing packer configured to expand against a wellbore wall; and a casing pad coupled to the lower casing section above the external casing packer and wherein rotation of the lower casing section is impedeable via the casing pad while the upper casing section is rotatable; and wherein the upper casing section is configured to rotate during a cement operation while the lower casing section is impeded with respect to the upper casing section.

13. A drilling system comprising:

a drill string apparatus comprising:

an upper casing section comprising a port collar that provides a controllable opening from an interior of the upper casing section to an annulus surrounding the upper casing section; and a lower casing section coupled to the upper casing section through a swivel, the lower casing section comprising an external casing packer coupled to an external portion of the lower casing section and configured to expand against a wellbore wall before cement operation; and a point the bit rotary steerable system (RSS) disposed within the lower casing section, the RSS being coupled to the lower casing section with a set of latches.

14. The drilling system of claim 13, wherein the lower casing section is configured to be stationary while the upper casing section is configured to rotate with the port collar open during the cementing.

15. The drilling system of claim 13, further comprising a drill bit coupled to an internal shaft of the RSS.

16. The drilling system of claim 15, further comprising a mud motor coupled to a driveshaft wherein the driveshaft is coupled to the internal shaft of the RSS.

17. The drilling system of claim 15, further comprising an underreamer coupled to the internal shaft of the RSS between the drill bit and the RSS.

18. The drilling system of claim 15, wherein the drill bit further comprises an underreamer.

19. A drilling system for drilling a wellbore having a wellbore wall, comprising:

a drill string apparatus comprising:

an upper casing section comprising a port collar that provides a controllable opening from an interior of the upper casing section to an annulus surrounding the upper casing section;

a lower casing section coupled to the upper casing section through a swivel, the lower casing section comprising an external casing packer coupled to an external portion of the lower casing section and configured to expand against the wellbore wall before cement operation; and a casing pad configured to impede rotation of the lower casing section while the upper casing section is rotatable; and wherein the upper casing section comprises an upper liner section and the lower casing section comprises a lower liner section.

20. The drilling system of claim 19, further comprising:

a point the bit rotary steerable system (RSS) disposed within the lower casing section, the RSS being coupled to the lower casing section with a set of latches; and wherein the lower casing section is configured to be stationary while the upper casing section is configured to rotate with the port collar open during a cementing operation.

21. The drilling system of claim 20, further comprising a drill bit coupled to an internal shaft of the RSS.

22. The drilling system of claim 21, further comprising a mud motor coupled to a driveshaft wherein the driveshaft is coupled to the internal shaft of the RSS.

23. The drilling system of claim 21, further comprising an underreamer coupled to the internal shaft of the RSS between the drill bit and the RSS.

24. The drilling system of claim 21, wherein the drill bit further comprises an underreamer.

25. A drilling system comprising:

a drill string apparatus comprising:

an upper casing section comprising a port collar that provides a controllable opening from an interior of the upper casing section to an annulus surrounding the upper casing section;

a lower casing section coupled to the upper casing section through a swivel, the lower casing section comprising an external casing packer coupled to an external portion of the lower casing section and configured to expand against a wellbore wall; and wherein the upper casing section comprises an upper liner section and the lower casing section comprises a lower liner section;

a point the bit rotary steerable system (RSS) disposed within the lower casing section, the RSS being coupled to the lower casing section with a set of latches; and wherein the lower casing section is configured to be stationary while the upper casing section is configured to rotate with the port collar open during a cementing operation.

26. The drilling system of claim 25, further comprising a drill bit coupled to an internal shaft of the RSS.

27. The drilling system of claim 26, further comprising a mud motor coupled to a driveshaft and wherein the driveshaft is coupled to the internal shaft of the RSS.

28. The drilling system of claim 26, further comprising an underreamer coupled to the internal shaft of the RSS between the drill bit and the RSS.

29. The drilling system of claim 26, wherein the drill bit further comprises an underreamer.

* * * * *